United States Patent [19]

Tachibana et al.

[11] Patent Number: 5,038,740

[45] Date of Patent: Aug. 13, 1991

[54] SYSTEM FOR CONTROLLING FUEL INJECTION QUANTITY AT START OF TWO-CYCLE ENGINE

[75] Inventors: Fusao Tachibana, Tokyo; Yoshiki Yuzuriha, Isesaki, both of Japan

[73] Assignees: Fuji Heavy Industries Ltd., Tokyo; Japan Electronic Control Systems Co., Ltd., Isesaki, both of Japan

[21] Appl. No.: 603,441

[22] Filed: Oct. 26, 1990

[51] Int. Cl.[5] ..... F02D 41/06

[52] U.S. Cl. ..... 123/491; 123/494; 123/179 L

[58] Field of Search ..... 123/179 G, 179 L, 491, 123/494

[56] References Cited

U.S. PATENT DOCUMENTS

| | | | |
|---|---|---|---|
| 4,582,036 | 4/1986 | Kiuchi et al. | 123/491 |
| 4,599,695 | 7/1986 | Deutsch | 123/491 X |
| 4,619,237 | 10/1986 | Auslander et al. | 123/491 |
| 4,628,886 | 12/1986 | Onishi | 123/491 |
| 4,724,816 | 2/1988 | Kanno et al. | 123/491 |
| 4,844,039 | 7/1989 | Osaki et al. | 123/491 |

FOREIGN PATENT DOCUMENTS

| | | |
|---|---|---|
| 47-16212 | 5/1972 | Japan . |
| 63-255543 | 10/1988 | Japan . |

*Primary Examiner*—Willis R. Wolfe

*Attorney, Agent, or Firm*—Foley & Lardner

[57] ABSTRACT

Disclosed is a system for controlling the fuel injection quantity at the start of a two-cycle engine, in which a predetermined amount of a fuel is preliminarily injected when a key switch of the engine is turned on, the revolution speed of the engine is smaller than a reference value and the opening degree of a throttle valve takes a predetermined change pattern.

5 Claims, 6 Drawing Sheets

SYSTEM FOR CONTROLLING FUEL INJECTION QUANTITY AT START OF TWO-CYCLE ENGINE

BACKGROUND OF THE INVENTION (1) Field of the Invention

The present invention relates to an apparatus for controlling the fuel injection quantity at the start of a two-cycle engine. More particularly, the present invention relates to a system for controlling the fuel injection quantity at the start of a two-cycle engine of the type where a fuel is preliminarily injected before the revolution of the engine for shortening the time required for starting the engine, wherein the preliminary injection is appropriately performed to improve the startability.

(2) Description of the Related Art

As the 2-cycle engine for a two-wheeled vehicle or a snow mobile, there has been adopted an engine of the fuel supply system where injection of a fuel is electronically controlled by using a fuel injection valve (see, for example, Japanese Unexamined Patent Publication No. 63-255543). For example, there can be mentioned a system in which a fuel injection valve is arranged in an intake manifold zone of each cylinder and injection is simultaneously effected in all of the cylinders.

In such a two-wheeled vehicle of the electronically controlled fuel injection system, in order to improve the startability, the fuel injection quantity at the start is controlled so that the fuel injection quantity at the start is a little larger than the normal fuel injection quantity.

For example, at the start of an ignition switch, that is, at the time of cranking, a value computed according to the following equation is outputted:

$$Ti = Tcs \times K_1 \times K_2$$

wherein Ti represents the width of the injection pulse at the start, Tcs represents the basic fuel injection quantity, $K_1$ represents the revolution speed correction coefficient, and $K_2$ represents the time correction coefficient.

The basic fuel injection quantity at the start is an injection quantity stored in advance according to the engine temperature, the revolution correction coefficient is a coefficient changing according to the cranking revolution speed, and the time correction coefficient is a coefficient changing according to the cranking time.

In this two-cycle engine, since the fuel injection is effected in the intake manifold portion, the fuel becomes viscous, especially at a low temperature, and therefore, a long time is required for the fuel to travel to a combustion chamber and a long time is required for starting the engine.

As means for overcoming this disadvantage, there has been adopted a method in which the fuel is preliminarily injected while the engine is not rotated, that is, the fuel is injected at a time when a key switch is turned on (when a power source is turned on) (see Japanese Examined Patent Publication No. 47-16212). According to this control method, injection is effected when the key switch is turned on, irrespectively of the driver's intention.

Accordingly, for example, in the case where even if the key switch is turned on, it is only for listening on the radio and the engine is not started, or in the case where the key switch is frequently turned on and off by the drive's habitual practice, the fuel is unnecessarily injected and spent. Accordingly, this method cannot be regarded as an appropriate control method.

SUMMARY OF THE INVENTION

The present invention has been completed to overcome the above-mentioned disadvantage of the conventional technique, and it is a primary object of the present invention to improve the startability of a two-cycle engine of the type where a fuel is preliminarily injected before the start of revolution of the engine, by performing the preliminary injection of the fuel according to the driver's intention of starting the engine.

According to the present invention, this object can be attained by a system for controlling a fuel injection valve at the start of a two-cycle engine, which comprises, as shown in FIG. 1, a fuel injection valve, key switch operation state-judging means for judging the on-off state of a key switch of the engine, means for detecting the revolution speed of the engine, engine revolution speed-judging means for comparing a detection value signal outputted from the engine revolution speed-detecting means with a preliminarily set reference value signal of the engine revolution speed and judging the engine revolution speed, means for detecting the opening degree of a throttle valve, throttle valve opening degree change pattern-judging means for judging whether or not the opening degree of the throttle valve takes a predetermined change pattern within a predetermined time based on the detection signal outputted from the throttle valve opening degree-detecting means, and fuel injection valve-controlling means for controlling the fuel injection valve based on signals of judgement results outputted from the key switch operation state-judging means, engine revolution speed-judging means and throttle valve degree change pattern-judging means so that when the key switch of the engine is turned on, the revolution speed of the engine is smaller than the reference value and the opening degree of the throttle valve takes the predetermined change state within the predetermined time, a predetermined quantity of the fuel is preliminarily injected to the engine.

According to the present invention having the above-mentioned structure, when the key switch of the engine is turned on, the cranking revolution speed of the engine is smaller than the reference value and the opening degree of the throttle valve takes the predetermined pattern within the predetermined time from the point when the key switch is turned on, it is judged that there is an intention of starting the engine, and a predetermined quantity of a fuel is preliminarily injected to the engine.

When the key switch, engine revolution speed and throttle valve opening degree change pattern satisfy predetermined conditions at the start of the engine, it is considered that a driver has an intention of starting the engine, and only after confirmation of this intention, the preliminary injection of the fuel is performed. Accordingly, unnecessary supply of the fuel is prevented and optimum preliminary injection is carried out to improve the startability.

The above-mentioned reference value of the revolution speed of the engine may be a small value, for example, 10 r.p.m.

The throttle valve opening pattern-judging means can be constructed by means for recognizing that the change of the opening degree of the throttle valve takes a predetermined pattern according to the intention of starting the engine.

In this case, the pattern of the change of the throttle valve, which indicates that there is an intention of starting the engine, can be recognized based on whether or not the opening degree of the throttle valve becomes larger than a predetermined large angle (for example, 70°) within a predetermined time (for example, 2 seconds) after the opening degree of the throttle valve is smaller than a predetermined small angle (for example, 5°) for a predetermined time (for example, 1 second) and is then larger than this small angle within a predetermined time (for example, 2 seconds), and the opening degree then becomes smaller than the predetermined small angle within a predetermined time (for example, 2 seconds).

Preferably, the preliminary injection quantity is computed by correcting the basic preliminary injection quantity, which is stored according to the temperature, based on the sucked air temperature and the injection frequency.

Namely, the preliminary injection quantity Ti can be computed based on the basic preliminary injection quantity Tpre, sucked air temperature correction coefficient $K_{TA}$ and injection frequency correction coefficient Kn according to the following equation:

$$Ti = Tpre \times K_{TA} \times Kn$$

By correction the basic preliminary injection quantity according to the injection frequency in the above-mentioned manner, even if the start miscarries when there is an intention of starting the engine, the combustion chamber or intake manifold is not excessively covered with a fuel and the air-fuel ratio is prevented from becoming too rich.

The present invention will now be described in detail with reference to embodiments illustrated in the accompanying drawings. However, the present invention is not limited by these embodiments and various modifications can be freely made within the scope defined in the claims.

DETAILED DESCRIPTION OF THE PREFERRED EMBODIMENTS

Figure 1:
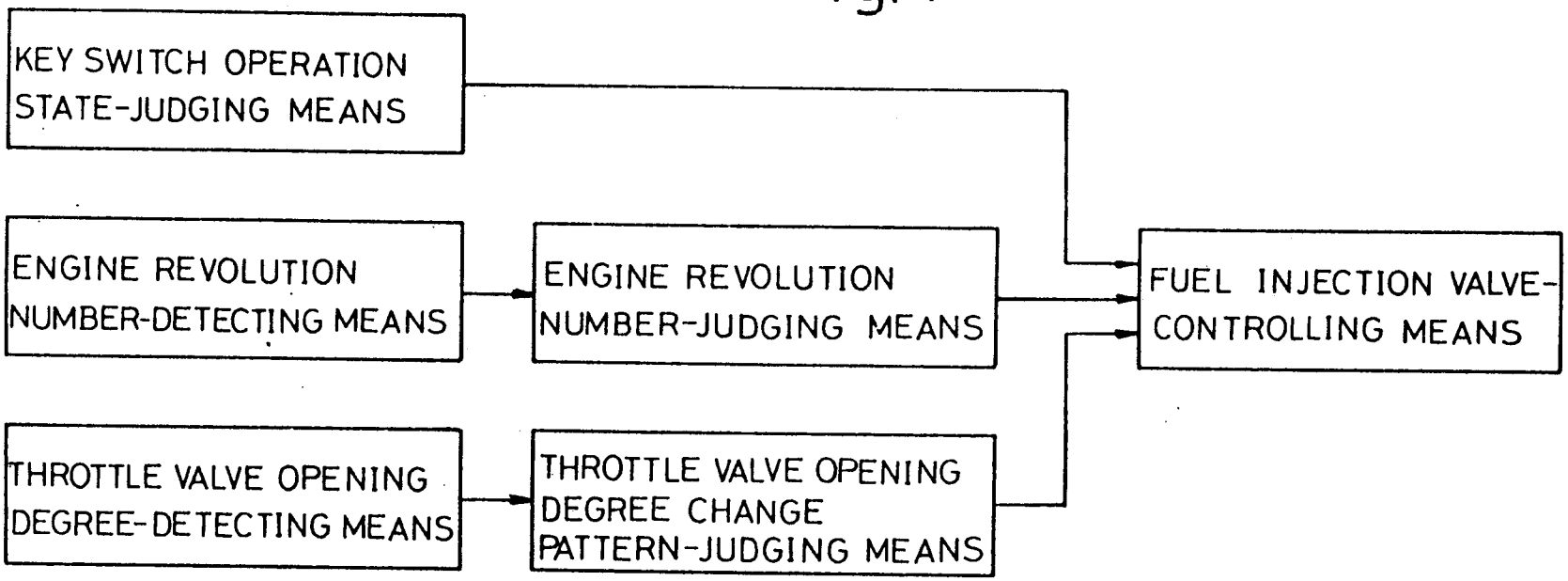
FIG. 1 is a functional block diagram illustrating the structure of the present invention.
Figure 2:
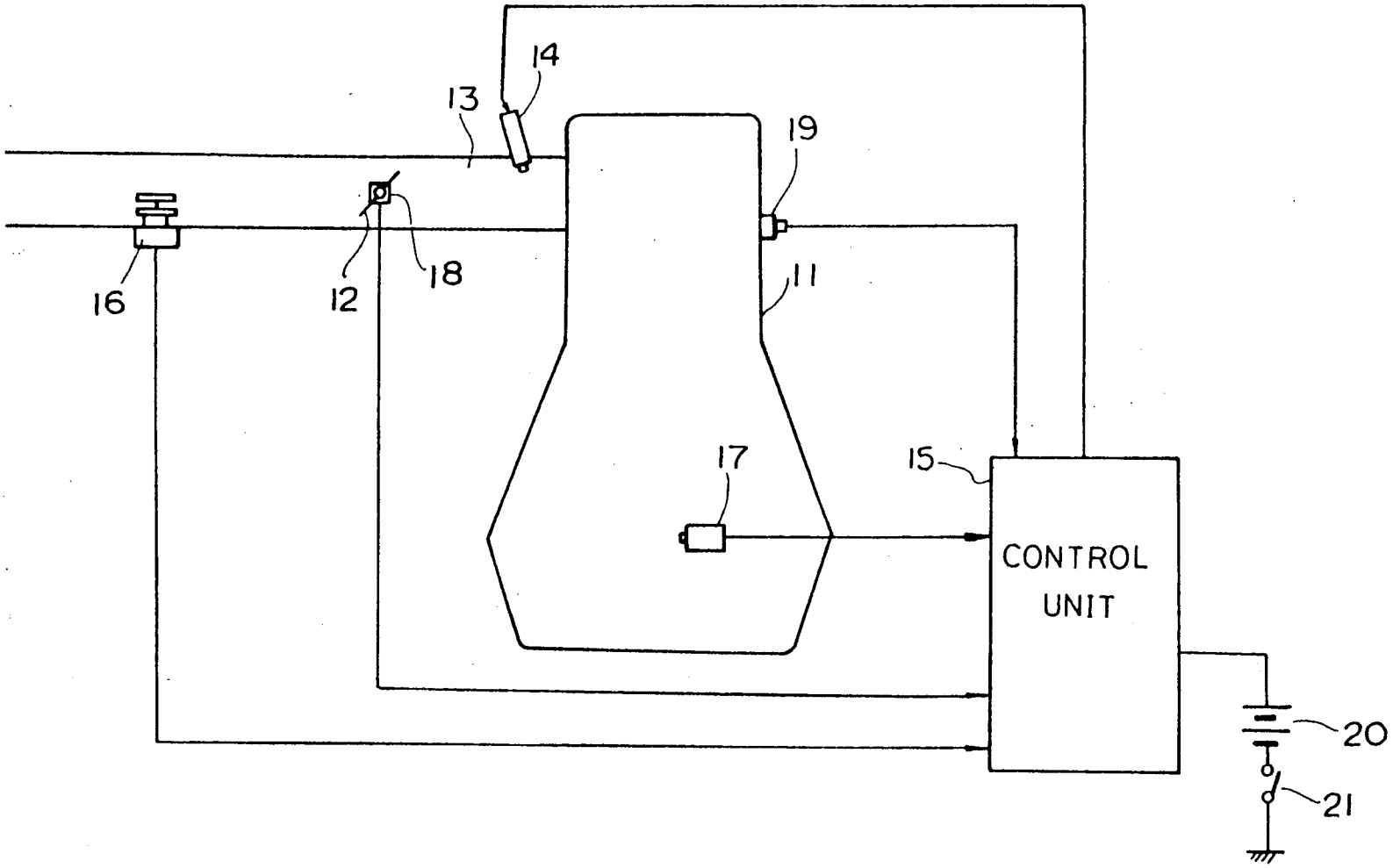
FIG. 2 is a system diagram illustrating one embodiment of the present invention.

FIG. 2 is a diagram of a control system of a two-cycle engine equipped with an electronically controlled fuel injection system as an example of the engine of the present invention. Air is sucked into this engine through an intake manifold 13 through an air cleaner not shown in the drawings via a throttle valve 12 operating with an accelerator pedal.

Fuel injection valves 14 for respective cylinders are arranged at a branch portion of the intake manifold 13. Each fuel injection valve 14 is an electromagnetic fuel injection valve which is opened by application of electricity to a solenoid and is closed by stopping of application of electricity to the solenoid. Namely, when the solenoid is actuated by a driving pulse signal from a control unit 15, the valve 14 is opened, while the valve 14 is opened, a fuel fed under pressure from a fuel pump and having a pressure adjusted to a predetermined level by a pressure regulator is injected and supplied to the engine.

Output signals from various sensors are inputted into the control unit 15, and an operation of input data is performed by a microcomputer built in the control unit 15 to determine a fuel injection quantity (injection time) Ti and an injection timing and a driving pulse signal is outputted to the fuel injection valve 14 according to the determined fuel injection quantity and injection timing. The control unit 15 outputs an operation control signal to an igniting apparatus 22 to control the ignition timing. The above-mentioned microcomputer comprises a central processing unit, an input-output processing unit, a memory and the like.

These sensors include an air flow meter 16 for outputting a signal corresponding to an intake air flow quantity Q and an engine crank angle sensor 17 built in a distributor not shown in the drawings to output a reference signal at every 120°. The revolution of the engine can be detected by measuring the frequency of this reference signal.

A throttle sensor 18 of the potentiometer type is disposed in the throttle valve 12 to output a signal corresponding to the opening degree $\alpha$ of the throttle valve 12. Furthermore, a water temperature sensor 19 is arranged in a water jacket of the engine 11 to output a signal corresponding to a cooling water temperature Tw. A voltage of a battery 20 as the operation power source or for detection of a power source voltage VB is applied to the control unit 15.

Figure 3:
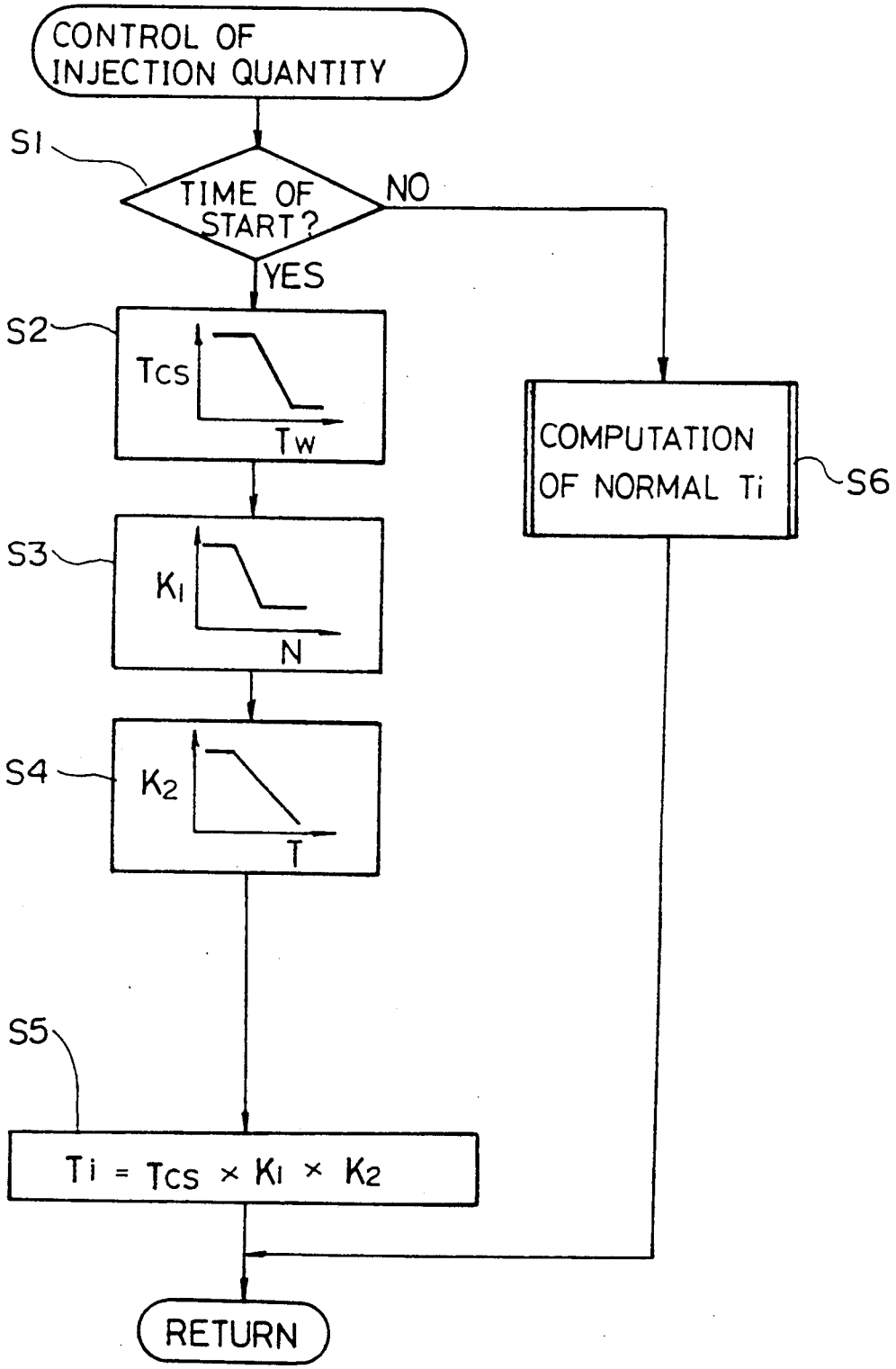
FIG. 3 is a flow chart showing the contents of the control of the fuel injection at the start of the engine.

The control of the fuel injection quantity at the start by the microcomputer in the control unit 15 will now be described with reference to the flow chart of FIG. 3.

At step 1 (referred to as "S1" in the drawings; subsequent steps are similarly indicated), it is judged by judging means in the control unit 15 whether or not it is the time of the start (the ignition switch is at the start position).

When the time of the start is judged, the routine goes into step 2 where the basic injection quantity Tcs stored in ROM is retrieved according to the cooling water temperature Tw detected as an example of the engine temperature by the water temperature sensor 19. Then, at step 3, the revolution speed correction coefficient $K_1$ stored in ROM is retrieved according to the revolution speed N of the engine.

At step 4, the time correction coefficient $K_2$ stored in ROM is retrieved by retrieving means in the control unit based on the cranking time T.

At step 5, the injection pulse width Ti at the start is computed according to the above-mentioned equation, and the control of opening and closing the fuel injection valve 14 is performed based on the result of the computation.

When the time other than the time of the start is recognized at step 1, the routine goes into step 6 and the normal control of Ti is performed.

The control unit 15 comprises key switch operation state-judging means for judging the on-off state of the key switch 21 of the engine based on an output signal of the key switch 21 and engine revolution speed-judging means for comparing a detection value outputted from the crank angle sensor 17 as the engine revolution speed-detecting means with a preliminary set reference value signal and judging whether or not the detection value is smaller than the reference value. The control unit 15 further comprises throttle valve opening degree change pattern-judging means for judging whether or not the opening degree of the throttle valve takes a predetermined change pattern within a predetermined time, based on a detection signal outputted from the throttle sensor 18 as the throttle valve opening degree-detecting means, and fuel injection valve-controlling means for controlling the fuel injection valve 14 to preliminary inject a predetermined amount of a fuel to the engine, based on the judgement results outputted from the key switch operation state-judging means, engine revolution speed-judging means and throttle valve opening degree change pattern-judging means when the output signal of the key switch 21 of the engine is turned on, the revolution speed of the engine is smaller than the reference value and the opening degree of the throttle valve takes the predetermined changed pattern within the predetermined time.

Incidentally, the fuel injection valve-controlling means is constructed to control the fuel injection valve so that the fuel is preliminarily injected in an amount computed by preliminary injection quantity-computing means comprising means for setting the basic preliminary injection quantity stored in advance according to the engine temperature, first correcting means for correcting the basic preliminary injection quantity according to the temperature of sucked air and second correcting means for correcting the basic preliminary injection quantity according to the injection frequency.

The operation of the respective means will now be described with reference to the preliminary injection-controlling routine shown in FIG. 4.

Figure 5:
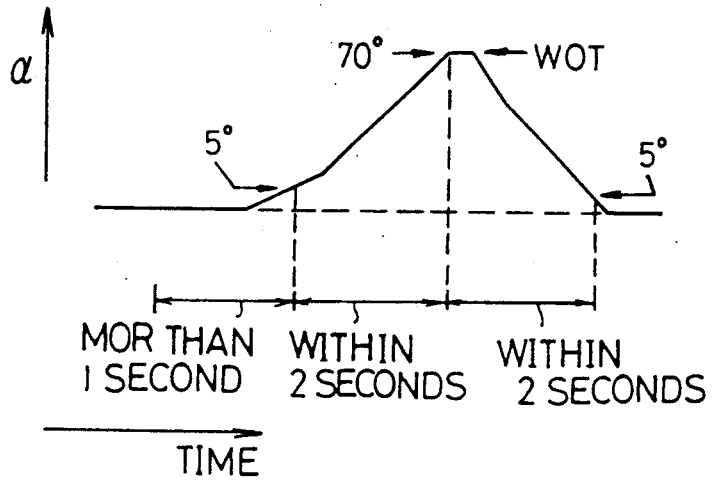
FIG. 5 is a characteristic diagram for judging the state of the change of the opening degree of the throttle valve with the lapse of time.

At step 11, it is judged whether or not the key switch of the engine is turned on, and if it is judged that the key switch is turned off, the routine returns and if it is judged that the key switch is turned on, the routine goes into step 13 where it is judged whether or not the revolution number N of the engine is smaller than a predetermined revolution speed (for example, 10 r.p.m.). If the revolution number N is larger than the predetermined revolution number, the routine returns, and if the revolution number N is smaller than the predetermined revolution speed, the routine goes into step 14. At step 14, it is judged whether or not the opening degree $\alpha$ of the throttle valve takes a predetermined change pattern within a predetermined time. Namely, as shown in the time chart of FIG. 5, it is judged whether or not the opening degree $\alpha$ of the throttle valve becomes larger than 70° within 2 seconds after the opening degree $\alpha$ of the throttle valve is smaller than 5° for more than 1 second and the opening degree $\alpha$ of the throttle valve then becomes more than 5°, and the angle $\alpha$ becomes smaller than 5° within 2 seconds. Incidentally, the foregoing times are measured by a timer arranged in the control unit 15.

If the opening degree $\alpha$ of the throttle valve does not change along the above-mentioned pattern, the routine returns, and if the opening degree $\alpha$ changes along the above-mentioned pattern, the routine goes into step 15.

Figure 6A:
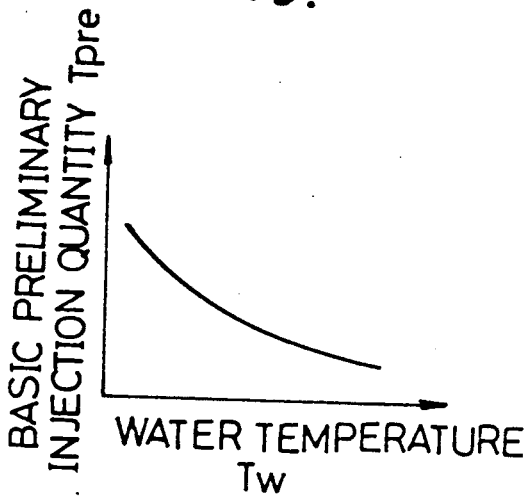
FIG. 6A is a characteristic diagram of the correction coefficient based on the basic preliminary injection quantity.

At step 15, the basic preliminary injection quantity Tpre stored in advance is retrieved based on the cooling water temperature Tw detected by the water temperature sensor 19, as shown in FIG. 6A.

Figure 6B:
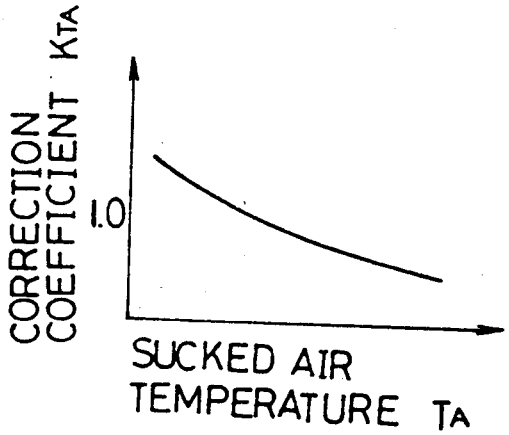
FIG. 6B is a characteristic diagram of the correction coefficient based on the sucked air temperature.

Then, at step 16, the sucked air temperature correction coefficient $K_{TA}$ determined in advance is retrieved based on the sucked air temperature TA detected by the sucked air temperature sensor not shown in the drawings, as shown in FIG. 6B.

Figure 6C:
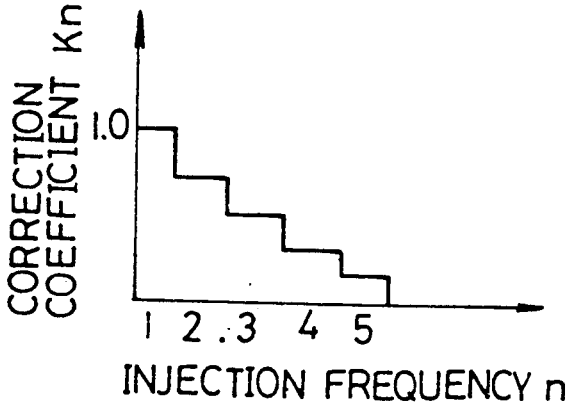
FIG. 6C is a characteristic diagram of the correction coefficient based on the fuel injection frequency.

The, at step 17, the frequency of the injection after the point when the power source is turned on is counted by increment of the frequency at every injection by a counter in the control unit 15, and at step 18, the frequency correction coefficient Kn (decreased at every injection) is retrieved based on the injection frequency, as shown in FIG. 6C.

Then, at step 19, the preliminary injection pulse width (preliminary injection quantity) Ti is computed according to the equation of $Ti = Tpre \times K_{TA} \times Kn$, and at step 20, injection is effected based on the computed preliminary injection pulse width Ti.

Figure 4:
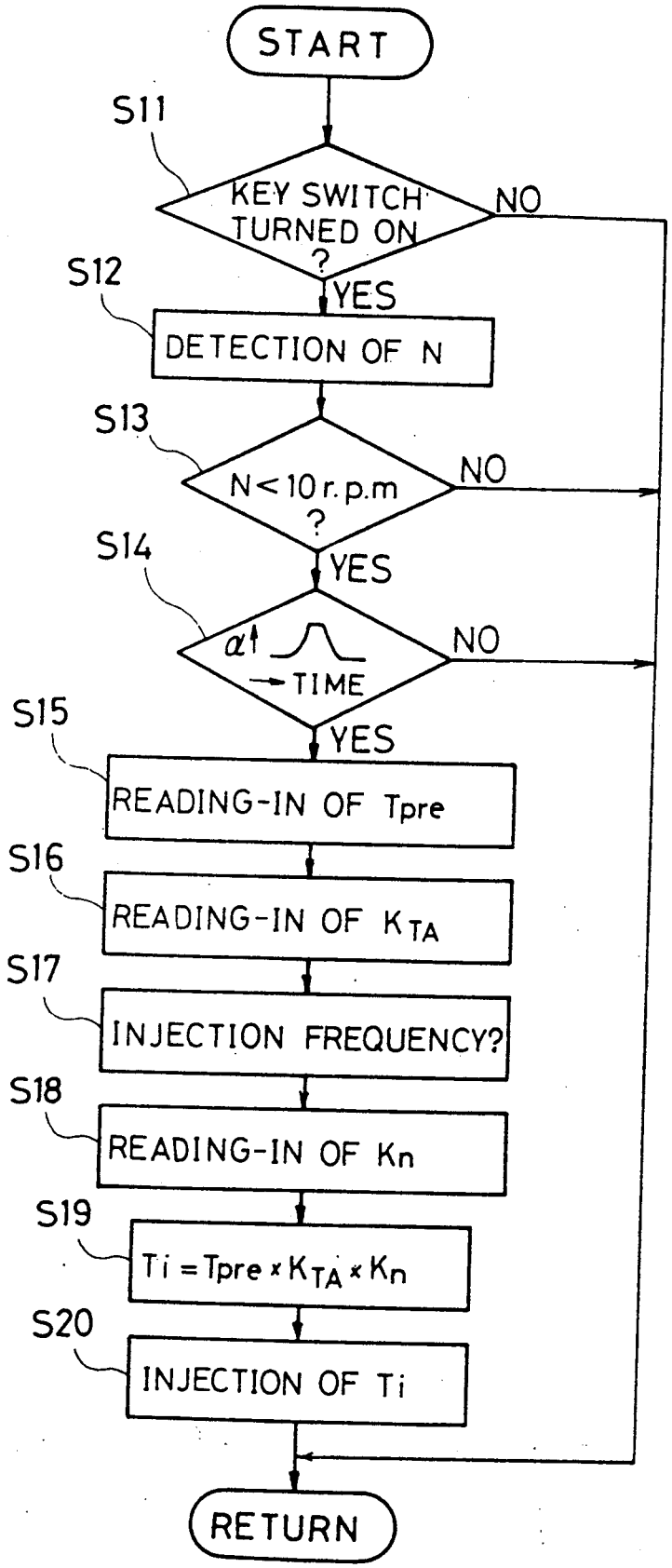
FIG. 4 is a flow chart showing the contents of the control of the preliminary injection.

In FIG. 4, step 11 corresponds to the key switch operation state-judging means, step 12 corresponds to the engine revolution speed-judging means, step 14 corresponds to the throttle valve opening degree change pattern-judging means, step 16 corresponds to the first correcting means, steps 17 and 18 correspond to the second correcting means, step 19 corresponds to the preliminary injection quantity-computing means, and step 20 corresponds to the fuel injection valve-controlling means.

Since the control system of the present invention is constructed so that only when certain predetermined conditions are satisfied while the engine key 21 is turned on, that is, when the revolution speed of the engine is smaller than the predetermined revolution number and the throttle valve 12 shows the predetermined change state, the fuel is preliminary injected in an amount determined according to the water temperature Tw, sucked air temperature TA and injection frequency n at this time. Accordingly, the preliminary injection can be performed according to the driver's intention of starting the engine.

For example, in the case where the engine is not started even when the key switch 21 is turned on, or in the case where the engine key is turned on and off repeatedly, injection of the fuel can be prevented and optimum preliminary injection can be performed, and therefore, the startability can be improved.

Figure 7:
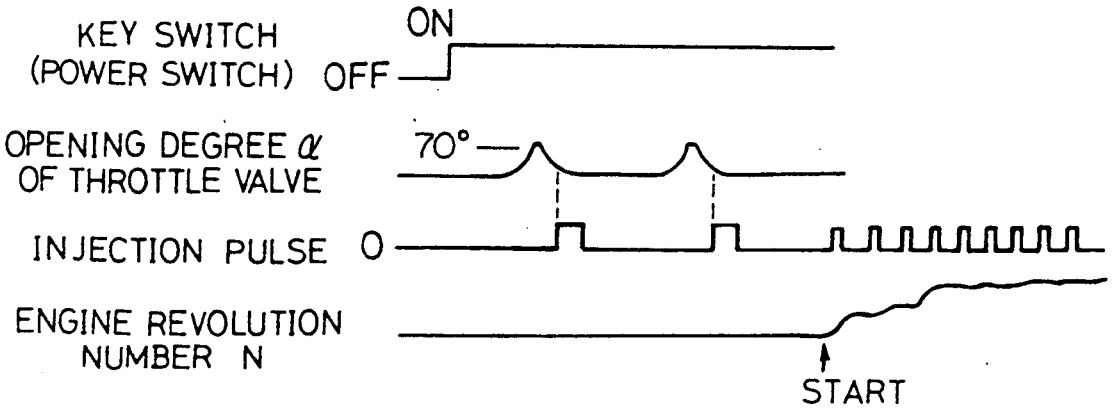
FIG. 7 is a time chart illustrating operations of respective elements with the lapse of time of from the point when the key switch is turned on to the point of the start of the engine through the preliminary injection.

Incidentally, FIG. 7 is a time chart showing the operations of the respective elements with the lapse of time from the point of the turning-on of the key switch to the point of the start of the engine through the preliminary injection.

We claim:

1. A system for controlling a fuel injection valve at the start of a two-cycle engine, which comprises a fuel injection valve, key switch operation state-judging means for judging the on-off state of a key switch of the engine, means for detecting the revolution speed of the engine, engine revolution speed-judging means for comparing a detection value signal outputted from the engine revolution speed-detecting means with a preliminarily set reference value signal of the engine revolution speed and judging the engine revolution speed, means for detecting the opening degree of a throttle valve, throttle valve opening degree change pattern-judging means for judging whether or not the opening degree of the throttle valve takes a predetermined change pattern within a predetermined time based on the detection signal outputted from the throttle valve opening degree-detecting means, and fuel injection valve-controlling means for controlling the fuel injection valve based on signals of judgement results outputted from the key switch operation state-judging means, engine revolution speed-judging means and throttle valve opening degree change pattern-judging means so that when the key switch of the engine is turned on, the revolution speed of the engine is smaller than the reference value and the opening degree of the throttle valve takes the predetermined change state within the predetermined time, a predetermined quantity of the fuel is preliminarily injected to the engine.

2. A fuel injection quantity-controlling system as set forth in claim 1, wherein the reference value of the revolution speed of the engine is 10 r.p.m.

3. A fuel injection quantity-controlling system as set forth in claim 1, wherein the fuel injection valve-controlling means is means for controlling the fuel injection valve so that a fuel is preliminarily injected in an amount computed by preliminary injection quantity-computing means.

4. A fuel injection quantity-controlling system as set forth in claim 3, wherein the preliminary injection quantity-computing means comprises means for setting the basic preliminary injection quantity stored in advance according to the engine temperature, first correcting means for correcting the basic preliminary injection quantity according to the sucked air temperature and second correcting means for correcting the basic preliminary injection quantity according to the injection frequency.

5. A fuel injection quantity-controlling system as set forth in claim 3, wherein the preliminary injection quantity-computing means is means for computing the preliminary injection quantity based on the basic preliminary injection quantity Tpre set by basic preliminary injection quantity-setting means, the sucked air temperature correction coefficient $K_{TA}$ set by first correcting means and the frequency correction coefficient Kn set by second correcting means according to the following equation:

$$Ti = Tpre \times K_{TA} \times Kn.$$

* * * * *